US007893891B2

(12) United States Patent
Kim et al.

(10) Patent No.: US 7,893,891 B2
(45) Date of Patent: Feb. 22, 2011

(54) DATA INTEGRATED CIRCUIT AND APPARATUS FOR DRIVING PLASMA DISPLAY PANEL USING THE SAME

(75) Inventors: Jin Young Kim, Daegu (KR); Seung Woo Woo, Daegu (KR)

(73) Assignee: LG Electronics Inc., Seoul (KR)

( * ) Notice: Subject to any disclaimer, the term of this patent is extended or adjusted under 35 U.S.C. 154(b) by 1107 days.

(21) Appl. No.: 11/156,465

(22) Filed: Jun. 21, 2005

(65) Prior Publication Data

US 2006/0066514 A1 Mar. 30, 2006

(30) Foreign Application Priority Data

Sep. 30, 2004 (KR) ..... 10-2004-0078089

(51) Int. Cl.
*G09G 3/28* (2006.01)

(52) U.S. Cl. ..... 345/67; 257/786

(58) Field of Classification Search ..... 345/60–70, 345/204; 315/169.4; 361/803; 257/690, 257/786; 326/41, 101
See application file for complete search history.

(56) References Cited

U.S. PATENT DOCUMENTS

2002/0033810 A1 3/2002 Matsuyama
2004/0164931 A1 * 8/2004 Han et al. ..... 345/60

FOREIGN PATENT DOCUMENTS

CN 1339771 A 3/2002
JP 3-225949 A 10/1991
JP 5-46115 A 2/1993
JP 5-303601 A 11/1993
JP 6-297765 A 10/1994
JP 2000-103111 A 4/2000
JP 2002-014625 * 1/2002
JP 2002-328390 A 11/2002
KR 10-2001-0082964 A 8/2001
TW 460722 10/2001
TW 525134 3/2003

OTHER PUBLICATIONS

Superflex Inc: HV582 "96- Channel AC Plasma Display Data Driver with High Voltage Push-Pull Outputs" Sep. 16, 2002 XP002372422 pp. 1-8.
St Microelectronics STV 7612 "Plasma Display Panel Data Driver" Aug. 1, 2003 XP002372423 pp. 1-18.
St Microelectronics STV 7610A "Plasma Display Panel Data Driver" Aug. 1, 2003 XP002372424 pp. 1-14.
NEC Data Sheet μPD16337 Jan. 31, 1998.
NEC Data Sheet μPD16347 Dec. 31, 2002.

* cited by examiner

*Primary Examiner*—Chanh Nguyen
*Assistant Examiner*—Allison Walthall
(74) *Attorney, Agent, or Firm*—Birch, Stewart, Kolasch & Birch, LLP

(57) ABSTRACT

An integrated circuit (IC) device for controlling a plurality of electrodes in a plasma display device, and a plasma display device including one or more IC devices, are provided. The IC device includes a plurality of output parts coupled to the plurality of electrodes, first and second terminals coupled to end portions of the IC device, and at least one third terminal between the first and second terminals and to supply a predetermined voltage to the IC device.

8 Claims, 5 Drawing Sheets

DATA INTEGRATED CIRCUIT AND APPARATUS FOR DRIVING PLASMA DISPLAY PANEL USING THE SAME

This nonprovisional application claims priority under 35 U.S.C. §119(a) on Patent Application No. 10-2004-0078089 filed in Repulic of Korea on Sep. 30, 2004, the entire contents of which are hereby incorporated by reference.

BACKGROUND OF THE INVENTION

1. Field of the Invention

The present invention relates to a data integrated circuit (IC) and an apparatus for driving a plasma display panel (PDP) using the same, and more particularly to a data IC capable of improving display quality and an apparatus for driving a PDP using the same.

2. Description of the Background Art

A plasma display panel (PDP) emits light from a fluorescent body by ultraviolet (UV) rays of 147 nm generated when an inactive mixed gas such as He+Xe, Ne+Xe, and He+Xe+Ne is discharged to display images including characters and graphics. Such a PDP is easily made thin and large and provides significantly improved picture quality due to recent development of technology. In particular, wall charges are accumulated on the surface of a three-electrode AC surface discharge type PDP during discharge and electrodes are protected against sputtering generated by discharge such that the three-electrode AC surface discharge type PDP is driven by a low voltage and has a long life.

Referring to FIG. 1, a discharge cell of the three-electrode AC surface discharge type PDP according to a background art includes a scan electrode Y and a sustain electrode Z formed on a top substrate 10 and an address electrode X formed on a bottom substrate 18. The scan electrode Y and the sustain electrode Z include transparent electrodes 12Y and 12Z, and metal bus electrodes 13Y and 13Z having a line width smaller than the line width of the transparent electrodes 12Y and 12Z and formed at one edge of each of the transparent electrodes, respectively.

The transparent electrodes 12Y and 12Z are commonly formed of indium-tin-oxide (ITO) on the top substrate 10. The metal bus electrodes 13Y and 13Z are commonly formed of metal such as Cr on the transparent electrodes 12Y and 12Z to reduce reduction in a voltage caused by the transparent electrodes 12Y and 12Z having high resistance. A top dielectric layer 14 and a protective layer 16 are laminated on the top substrate 10 on which the scan electrode Y and the sustain electrode Z are formed in parallel. Wall charges generated during plasma discharge are accumulated on the top dielectric layer 14. The protective layer 16 prevents the top dielectric layer 14 from being damaged by sputtering generated during plasma discharge and improves efficiency of emitting secondary electrons. MgO is commonly used as the protective layer 16.

A bottom dielectric layer 22 and a partition wall 24 are formed on the bottom substrate 18 on which the address electrode X is formed. The surfaces of the bottom dielectric layer 22 and the partition wall 24 are coated with a fluorescent body layer 26. The address electrode X is formed to intersect the scan electrode Y and the sustain electrode Z. The partition wall 24 is formed to run parallel with the address electrode X to prevent the UV rays and the visible rays generated by discharge from leaking to an adjacent discharge cell. The fluorescent body layer 26 is excited by the UV rays generated during plasma discharge to generate any one visible ray among red, green, and blue visible rays. An inactive mixed gas is implanted into a discharge space provided between the top and bottom substrates 10 and 18 and the partition wall 24.

In order to realize gray scales of an image, a PDP divides a frame into various sub fields having a different number of light emissions to perform time division driving. Each sub field is divided into an initializing period for initializing the entire screen, an address period for selecting a scan line and for selecting a cell from the selected scan line, and a sustain period for realizing gray scales in accordance with the number of times the discharge is made.

Here, the initializing period is divided into a set up period to which a rising ramp waveform is supplied and a set down period to which a falling ramp waveform is supplied. For example, when an image is displayed by 256 gray scales, as illustrated in FIG. 2, a frame period (16.67 ms) corresponding to 1/60 second is divided into eight sub fields SF1 to SF8. As described above, each of the eight sub fields SF1 to SF8 is divided into the initializing period, the address period, and the sustain period. Meanwhile the initializing period and the address period of the respective sub fields are the same, and the sustain period in each sub field increases in the ratio of 2n(n=0, 1, 2, 3, 4, 5, 6, and 7) as the sub field number increases.

FIG. 3 illustrates an apparatus for driving a PDP according to a background art.

Referring to FIG. 3, the apparatus for driving a PDP includes an address driving part 32 for driving address electrodes X1 to Xk provided on a plasma panel 30, a scan driving part 34 for driving scan electrodes Y1 to Yn provided on the panel 30, and a sustain driving part 36 for driving sustain electrodes Z1 to Zn provided on the panel 30.

The scan driving part 34 supplies a reset pulse, a scan pulse, and a sustain pulse to the scan electrodes Y1 to Yn. Here, the reset pulse and the sustain pulse are commonly supplied to all of the scan electrodes Y1 to Yn and the scan pulse is sequentially supplied to the scan electrodes Y1 to Yn.

The address driving part 32 generates data pulses (driving voltage) corresponding to image data provided from the outside and supplies them to the address electrodes X1 to Xk. Here, the data pulses are supplied to be synchronized with the scan pulse sequentially supplied to the scan electrodes Y1 to Yn.

The sustain driving part 36 supplies an electrode negative voltage (an electrode negative bias voltage) and the sustain pulse (the driving voltage) to the sustain electrodes Z1 to Zn. Here, the electrode negative voltage and the sustain pulse are commonly supplied to all of the sustain electrodes Z1 to Zn.

FIG. 4 illustrates a data integrated circuit (IC) in the driving apparatus of FIG. 3 according to the background art.

Referring to FIG. 4, in the driving apparatus of FIG. 3, the address driving part 32 includes one or more data ICs 40 having i output parts 42 electrically connected to address electrodes X1-Xi of the address electrodes X1-Xk, where i is a natural number. Although not shown, the output parts 42 receive a driving voltage (data pulses) Vh corresponding to image data input to the address driving part 32, and supply it to the address electrodes X1-Xi. Also a first end terminal 44 and a second end terminal 46 are provided on both ends of the data IC 40. The first end terminal 44 receives a ground voltage GND from the outside and supplies the received GND to the output parts 42 near the first end terminal 44. The second end terminal 46 also receives a ground voltage GND from the outside and supplies the received ground voltage GND to the output parts 42 near the second end terminal 46. The use of the first and second end terminals 44 and 46 to receive the ground voltage GND is known. The respective output parts 42 that received the driving voltage Vh and the ground voltage GND supply the data pulses corresponding to the image data to the address electrodes X1-Xi connected thereto.

According to the background art PDP, in order to cause sustain discharge, the sustain pulse having a high voltage value is alternately supplied to the scan electrodes Y and the sustain electrodes Z during the sustain period. Here, the sustain pulse having the high voltage value passes through the discharge cells that are equivalent to capacitors and is supplied to the output parts 42 of the data IC 40.

However, in the background art PDP, the brightness displayed by the address electrodes X connected to the output parts 42 positioned in the center of the data IC 40 is different from the brightness displayed by the address electrodes X connected to the output parts 42 positioned at the end portions of the data IC 40, such that spot-like noise is generated due to the difference in the brightness, which deteriorates display quality. Such a phenomenon occurs because the amount of the ground voltage GND supplied to the output parts 42 positioned at the center part of the data IC 40 is insufficient due to the fact that there are only two end terminals 44 and 46 that receive the ground voltage GND. As a result, the output parts 42 positioned at the center part of the data IC 40 are significantly affected by the high sustain voltage. In particular, the more the capacitor components of the discharge cells are and the larger the number of output parts 42 included in the data IC 40 is, the more significant the difference in the brightness becomes. For instance, to provide a PDP having a high resolution, a large number of output parts 42 may be provided in the data IC 40. In that case, however, the above problem of inconsistent brightness on the panel occurs due to the configuration of the data IC, thereby deteriorating the picture quality of the panel. This problem is also prominent in PDPs that use a single scan method.

SUMMARY OF THE INVENTION

Accordingly, an object of the present invention is to solve at least the above and other problems and disadvantages of the background art.

It is another object of the present invention to provide a data integrated circuit (IC) capable of improving display quality and an apparatus for driving a plasma display panel (PDP) using the same.

According to the data IC of the present invention and the apparatus for driving a PDP using the same, it is possible to display images with uniform brightness by supplying a ground voltage directly to the center part of the data IC.

According to an aspect of the present invention, there is provided an integrated circuit (IC) device for controlling a plurality of electrodes in a plasma display device, the IC device comprising: a plurality of output parts coupled to the plurality of electrodes; first and second terminals coupled to end portions of the IC device; and at least one third terminal between the first and second terminals and to supply a predetermined voltage to the IC device.

According to anther aspect of the present invention, there is provided a plasma display apparatus having discharge cells at intersections of scan electrodes and address electrodes, the plasma display apparatus comprising: a driving part including one or more integrated circuit (IC) devices to control the address electrodes, the IC device including a plurality of output parts coupled to at least some of the plurality of address electrodes, first and second terminals coupled to end portions of the IC device, and at least one third terminal between the first and second terminals and to supply a predetermined voltage to the IC device.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

Hereinafter, preferred embodiments of the present invention will be described in detail with reference to FIGS. 5, 6 and 7.

Figure 1:
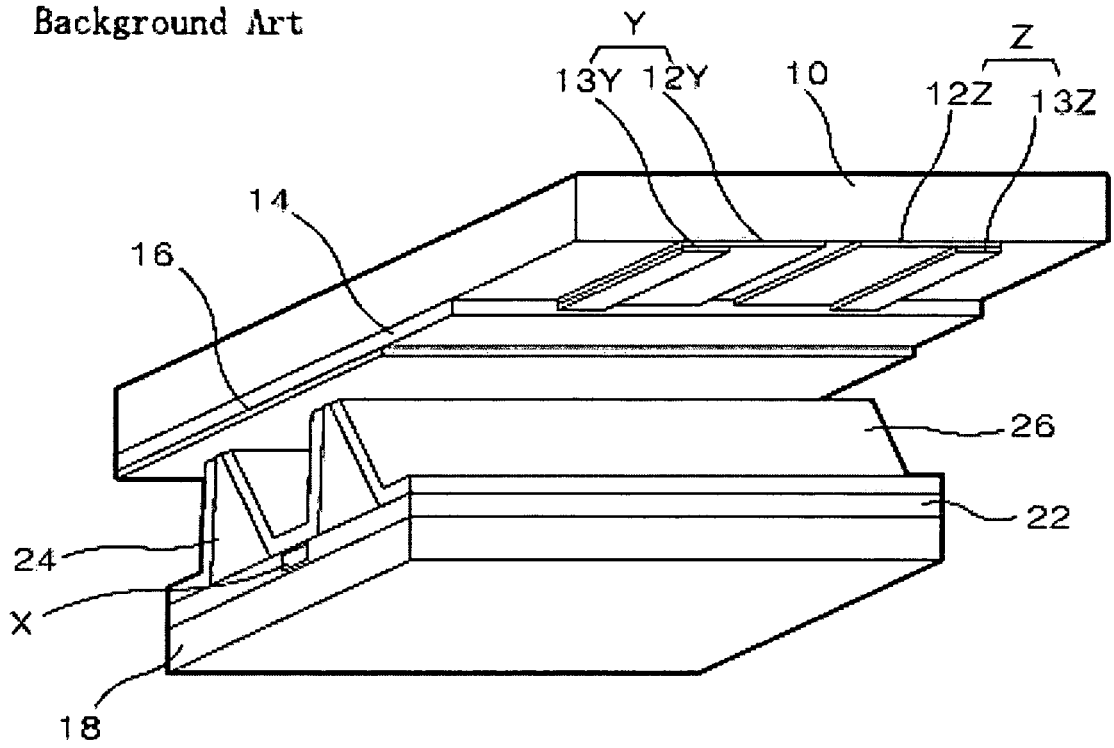
FIG. 1 is a perspective view illustrating the structure of a discharge cell of a three-electrode AL surface discharge type plasma display panel (PDP) according to a background art.
Figure 2:
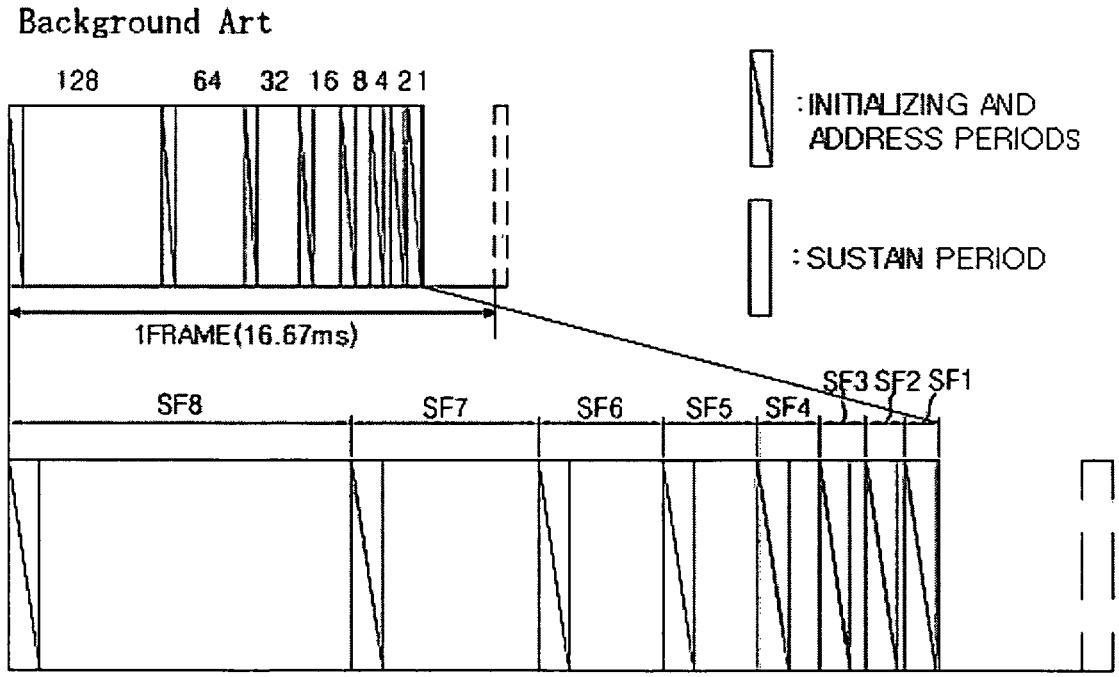
FIG. 2 illustrates an example of a brightness weight value of a PDP according to a background art.
Figure 3:
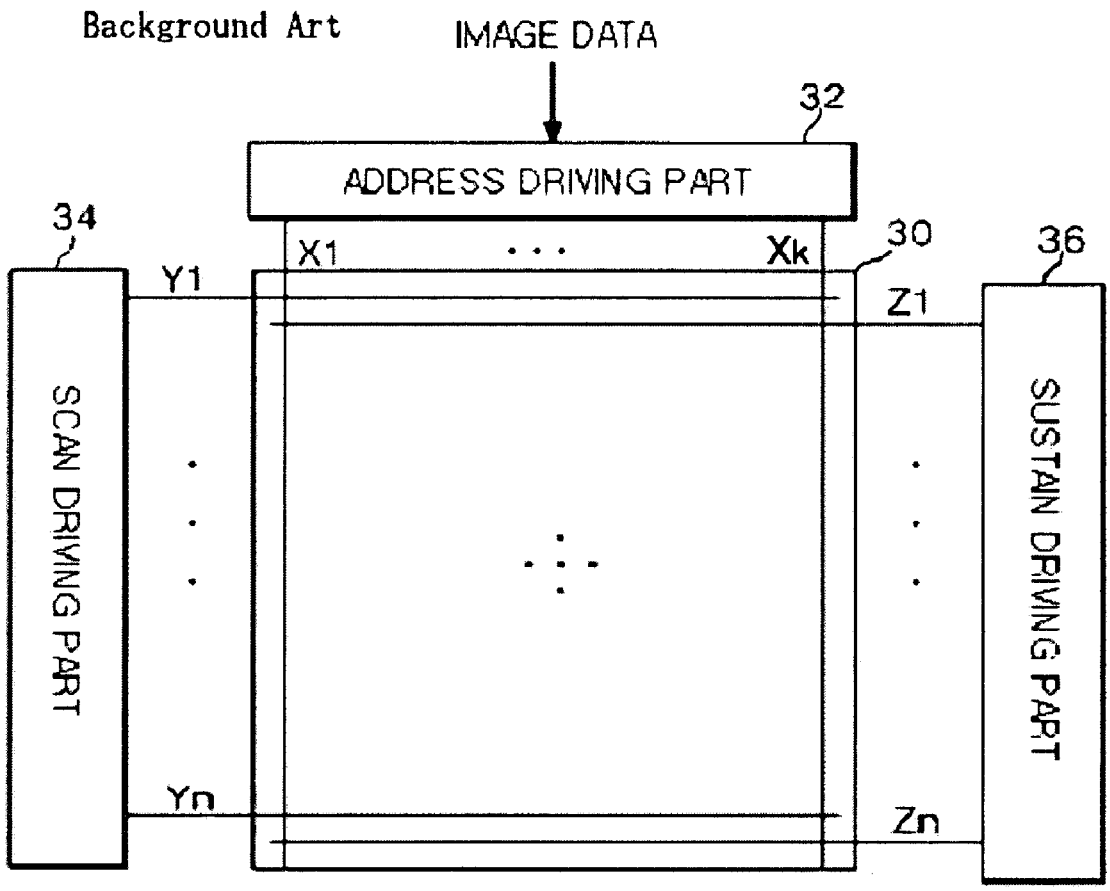
FIG. 3 illustrates an apparatus for driving a PDP according to a background art.
Figure 4:
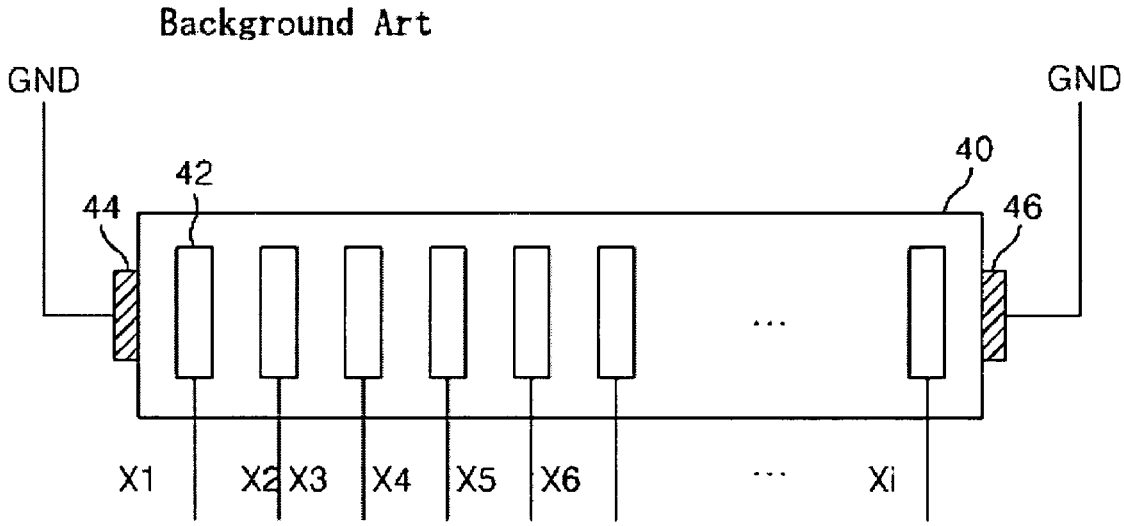
FIG. 4 illustrates a data IC in the driving apparatus of FIG. 3 according to a background art.
Figure 5:
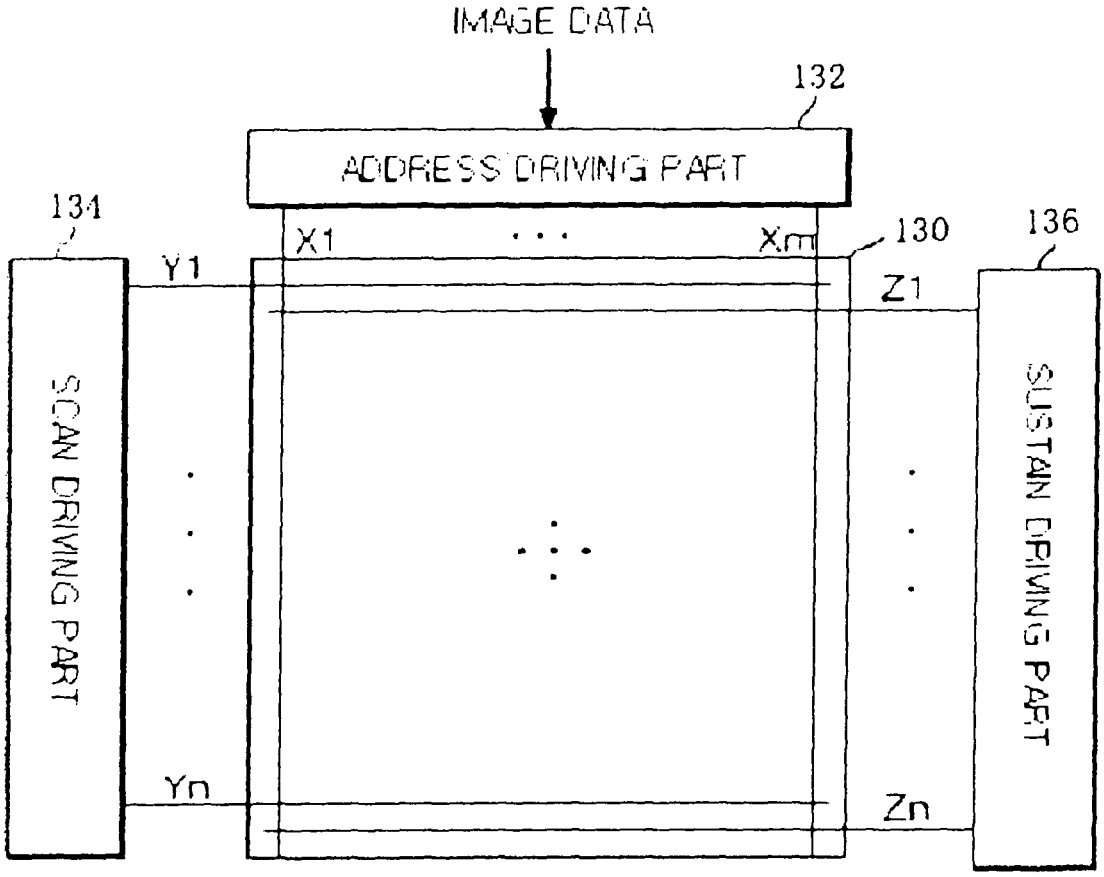
FIG. 5 illustrates an apparatus for driving a PDP according to an embodiment of the present invention.

FIG. 5 illustrates an apparatus for driving a PDP according to an embodiment of the present invention.

Referring to FIG. 5, the apparatus for driving a PDP includes an address driving part 132 for driving address electrodes X1 to Xm provided on a plasma panel 130, a scan driving part 134 for driving scan electrodes Y1 to Yn provided on the panel 130, and a sustain driving part 136 for driving sustain electrodes Z1 to Zn provided on the panel 130. The panel 130 has known configurations and structures.

The scan driving part 134 supplies a reset pulse, a scan pulse, and a sustain pulse to the scan electrodes Y1 to Yn. Here, the reset pulse and the sustain pulse are commonly supplied to all of the scan electrodes Y1 to Yn and the scan pulse is sequentially supplied to the scan electrodes Y1 to Yn. The reset pulse, the scan pulse, and the sustain pulse as the driving voltage of the scan electrodes are supplied to the scan driving part 134.

The address driving part 132 generates data pulses (driving voltage) corresponding to image data provided from the outside and supplies them to the address electrodes X1 to Xm. Here, the data pulses are supplied to be synchronized with the scan pulse sequentially supplied to the scan electrodes Y1 to Yn. The data pulses as the driving voltage of the address electrodes are supplied to the address driving part 132.

The sustain driving part 136 supplies an electrode negative voltage (an electrode negative bias voltage) and the sustain pulse (the driving voltage) to the sustain electrodes Z1 to Zn.

Here, the electrode negative voltage and the sustain pulse are commonly supplied to all of the sustain electrodes Z1 to Zn. The electrode negative voltage and the sustain voltage as the driving voltage of the sustain voltage are supplied to the sustain driving part 136.

Figure 6:
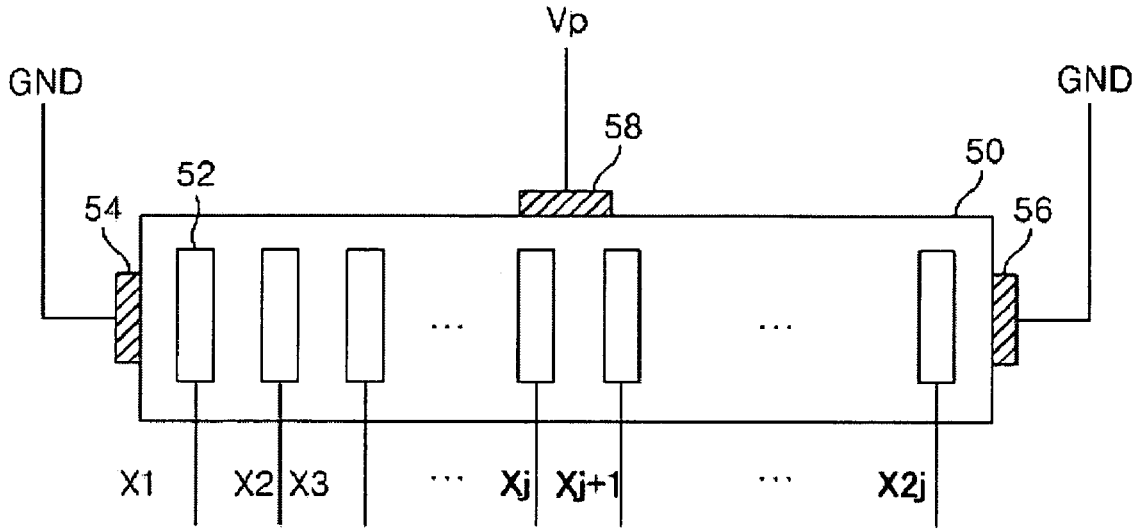
FIG. 6 illustrates a data IC in the driving apparatus of FIG. 5 according to an embodiment of the present invention.

FIG. 6 illustrates a data IC 50 in the driving apparatus of FIG. 5 according to an embodiment of the present invention. The address driving part 132 can include one or more data ICs 50 that are connected to the address electrodes X1-Xm.

Referring to FIG. 6, the data IC 50 according to an embodiment of the present invention includes 2*j* output parts 52 electrically connected to address electrodes X1-X2*j* of the address electrodes X1-Xm. Here, j is a natural number, and the number 2*j* can be less than or equal to m of Xm. Although not shown, as known the output parts 52 receive a driving voltage (data pulses) Vh corresponding to image data input to the address driving part 132, and supply it to the address electrodes X1-X2*j*.

Further, the data IC 50 includes a first input terminal 54, a second input terminal 56, and a third input terminal 58. The first input terminal 54, the second input terminal 56, and the third input terminal 58 may be terminals on a chip in which the integrated circuit is formed and may be outside connection terminals provided in a package that stores the chip to be connected to the corresponding terminals on the chip.

The first input terminal 54 is provided at one end of the data IC 50 to receive a ground voltage GND and supplies the received ground voltage GND to the output parts 52. The second input terminal 56 is provided at another end of the data IC 50 to receive a ground voltage GND and supplies the received ground voltage GND to the output parts 52. The third input terminal 58 is provided at the center or the center part of the data IC 50 to receive a predetermined voltage Vp and supplies the received predetermined voltage Vp to the output parts 52. Here, the predetermined voltage Vp is set as the ground voltage GND.

In another example, a plurality of third input terminals 58 may be provided at certain intervals on the outer surface of the data IC 50 between the first and second terminals 54 and 56. This configuration may be beneficial especially when a large number of output parts 52 are provided in the data IC 50.

Figure 7:
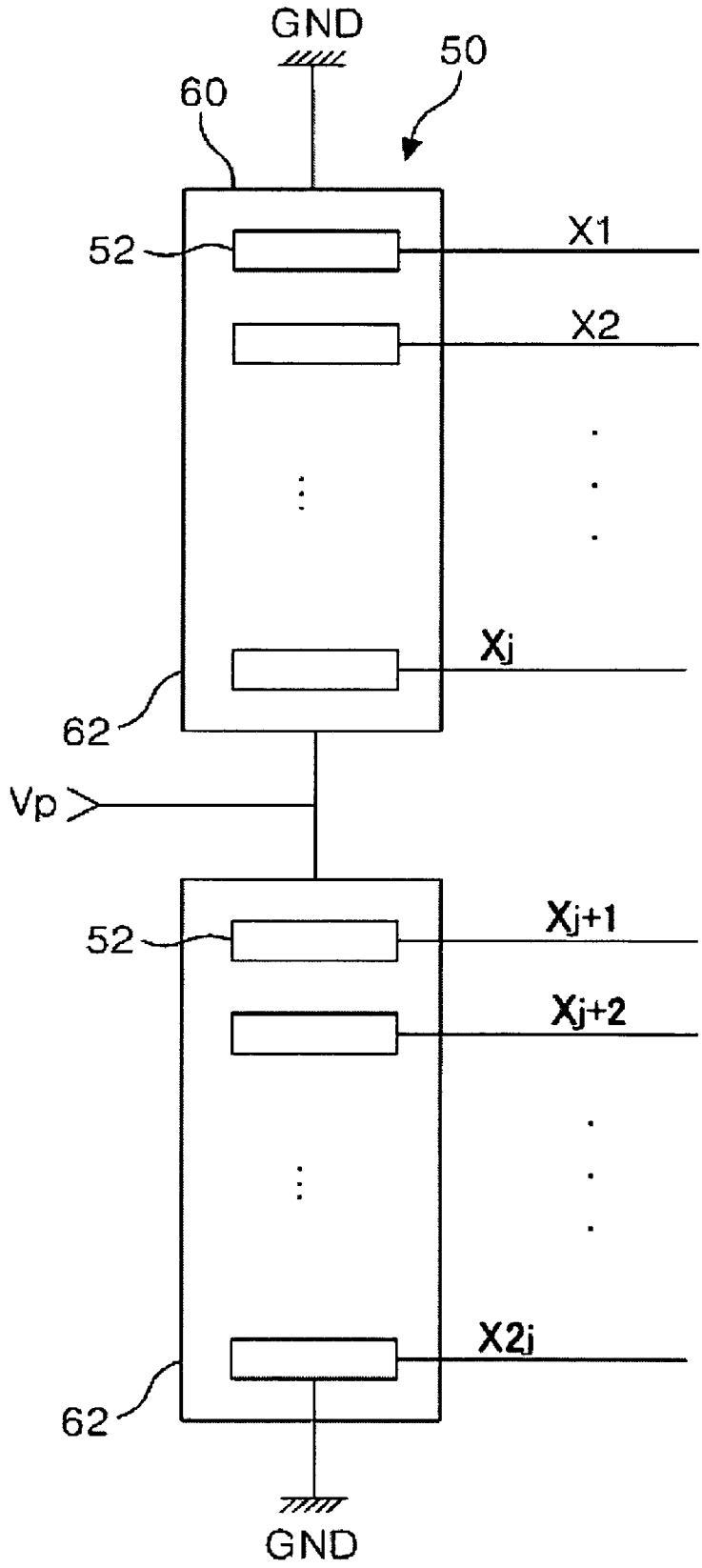
FIG. 7 illustrates the data IC of FIG. 6 implemented in another manner according to the present invention.

FIG. 7 illustrates the data IC of FIG. 6 implemented in another manner according to the present invention.

Referring to FIG. 7, the data IC 50 includes a first logic part 60 and a second logic part 62 each equivalently including j output parts 52. The ground voltage GND is supplied to one end of the first logic part 60 and one end of the second logic part 62. The predetermined voltage Vp is connected to the common terminal of the first logic part 60 and the second logic part 62. Here, the predetermined voltage Vp is a ground voltage GND. The driving voltage Vh is also supplied to the driving IC 50.

When the predetermined voltage Vp is supplied to the common terminal of the first logic part 60 and the second logic part 62 (that is, the third input terminal 58 and the common terminal are electrically connected to each other), a sufficient amount of ground voltage (GND) is supplied to the output parts 52 positioned at or near the center part of the data IC 50.

As described above, when a sufficient amount of ground voltage GND is supplied to the output parts 52 of the data IC 50, the sustain voltage supplied via the discharge cells is supplied to the ground voltage GND. Therefore, it is possible to prevent the output parts 52 positioned at or near the center part of the data IC 50 from being affected by the sustain voltage.

As noted by an experiment, the data IC 50 according to the present invention can display images with uniform brightness without deteriorating display quality even when the sustain pulse is set as a high voltage of no less than 100V. Also, according to the experiment, the data IC 50 according to the present invention can display images with uniform brightness without deteriorating display quality even when the number of output parts 52 is larger than 96 (that is, even when the data IC 50 includes a large number of channels).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An integrated circuit (IC) device for controlling a plurality of address electrodes in a plasma display device, the IC device having first and second end portions spaced by first and second side portions, and located on two opposite edges of the IC device, comprising:

a plurality of output parts coupled to the plurality of address electrodes and arranged along the first side portion of the IC device;

first and second terminals coupled to a ground voltage and disposed on the first and second end portions of the IC device, respectively, wherein the first and second terminals supply the ground voltage to the plurality of address electrodes via the plurality of output parts; and at least one third terminal provided in a middle of the second side portion, the second side portion being opposite to the plurality of output parts and configured to supply the ground voltage to the address electrodes disposed in a middle of the first side portion of the IC device while a sustain pulse is supplied to scan electrodes and sustain electrodes, and while said first and second terminals supply the ground voltage to the address electrodes disposed on ends of the first side portion of the IC device.

2. The IC device of claim 1, wherein the at least one third terminal includes a plurality of third terminals disposed at certain intervals between the first and second terminals.

3. The IC device of claim 1, wherein a number of the plurality of output parts is equal to or larger than 96.

4. A plasma display apparatus having discharge cells at intersections of scan electrodes and address electrodes, the plasma display apparatus comprising: a driving part including an integrated circuit (IC) device to control the address electrodes, the IC device having first and second end portions spaced by first and second side portions, and located on two opposite edges of the IC device, including, a plurality of output parts coupled to the address electrodes and arranged along the first side portion of the IC device, first and second terminals coupled a ground voltage and disposed on the first and second end portions of the IC device, respectively, wherein the first and second terminals supply the ground voltage to the plurality of address electrodes via the plurality of output parts, and at least one third terminal provided in a middle of the second side portion, the second side portion being opposite to the plurality of output parts and configured to supply the ground voltage to at least one of the plurality of address electrodes disposed in a middle of the first side portion of the IC device while a sustain pulse is supplied to scan electrodes and sustain electrodes, and while the first and second terminals respectively supply a ground voltage to at least one of the plurality of address electrodes disposed on each end of the first side portion of the IC device.

5. The plasma display apparatus of claim 4, further comprising:

a plasma panel including the discharge cells and being controlled by the driving part.

6. The plasma display apparatus of claim 4, wherein in the IC device, the number of the output parts is equal to or larger than 96.

7. The plasma display apparatus of claim 4, further comprising:

a plurality of sustain electrodes;

a scan driving part to control the scan electrodes; and a sustain driving part to control the sustain electrodes.

8. An integrated circuit (IC) device for controlling a plurality of address electrodes in a plasma display device, the IC device comprising:

first and second end portions spaced by first and second side portions, and located on two opposite edges of the IC device;

a plurality of output parts coupled to the plurality of address electrodes and arranged along the first side portion of the IC device;

first and second terminals coupled to the end portions of the IC device, wherein the first and second terminals supply a ground voltage to the plurality of address electrodes via the plurality of output parts; and at least one third terminal between the first and second terminals and to supply a ground voltage to the IC device, wherein the integrated circuit device includes a first logic part and a second logic part including the plurality of output parts, and wherein the ground voltage supplied by the third terminal is connected to a common terminal of the first logic part and the second logic part, and wherein the common terminal supplies the ground voltage to the address electrodes disposed in the middle of the first side of the IC device while a sustain pulse is supplied to scan and sustain electrodes and while said first and second terminals supply the ground voltage respectively to the address electrodes on each end of the first side of the IC device.

* * * * *